US008902115B1

(12) United States Patent
Loui et al.

(10) Patent No.: US 8,902,115 B1
(45) Date of Patent: Dec. 2, 2014

(54) RESONANT DIELECTRIC METAMATERIALS

(75) Inventors: Hung Loui, Albuquerque, NM (US); James Carroll, Albuquerque, NM (US); Paul G. Clem, Albuquerque, NM (US); Michael B. Sinclair, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 673 days.

(21) Appl. No.: 13/191,176

(22) Filed: Jul. 26, 2011

Related U.S. Application Data

(60) Provisional application No. 61/367,921, filed on Jul. 27, 2010.

(51) Int. Cl.
*H01Q 13/00* (2006.01)
*H01Q 15/08* (2006.01)

(52) U.S. Cl.
USPC ..... 343/785; 343/911 R

(58) Field of Classification Search
USPC ..... 343/785, 911 R
See application file for complete search history.

(56) References Cited

U.S. PATENT DOCUMENTS 7,750,869 B2 7/2010 Mosallaei
2009/0040131 A1* 2/2009 Mosallaei ..... 343/911 R

OTHER PUBLICATIONS

A. Ahmadi and H. Mosallaei, Physical Configuration and Performance Modeling of All-Dielectric Metamaterials, Physical Review B 77, 045104-1-045104-11 (2008).
A. Grbic and G. Eleftheriades, An Isotropic Three-Dimensional Negative-Refractive-Index Transmission-Line Metamaterial, Journal of Applied Physics 98, 043106-1-043106-5 (2005).
C. Holloway, et al., A Double Negative (DNG) Composite Medium Composed of Magnetodielectric Spherical Particles Embedded in a Matrix, IEEE Transactions on Antennas and Propagation, vol. 51, No. 10, Oct. 2003.
C. Holloway, et al., Realisation of a Controllable Metafilm/Metasuiface Composed of Resonant Magnetodielectric Particles: Measurements and Theory, IET Microwaves, Antennas & Propagation, 2010, vol. 4, Iss. 8, pp. 1111-1122.
J. Kim and A. Gopinath, Simulation of a Metamaterial Containing Cubic High Dielectric Resonators, Physical Review B 76, 115126-1-115126-6 (2007).
L. Peng, et al., Experimental Observation of Left-Handed Behavior in an Array of Standard Dielectric Resonators, Physical Review Letters, PRL 98, 157403-1-157303-4, Apr. 2007.
J. Valentine, et al., Three-Dimensional Optical Metamaterial with a Negative Refractive Index, Nature, vol. 455, Sep. 2008.
O. Vendik and M. Gashinova, Artificial Double Negative (DNG) Media Composed by Two Different Dielectric Sphere Lattices Embedded in a Dielectric Matrix, 34th European Microwave Conference, Amsterdam, 2004, pp. 1209-1212.
I. Vendik, et al., Isotropic Artificial Media with Simultaneously Negative Permittivity and Permeability, Microwave and Optical Technology Letters, vol. 48, No. 12, Dec. 2006.
I. Vendik, et al., 3D Metamaterial Based on a Regular Array of Resonant Dielectric Inclusions, Radioengineering, vol. 18, No. 2, Jun. 2009.
V.G. Veselago and E.E. Narimanov, The Left Hand of Brightness: Past, Present and Future of Negative Index Materials, Nature Materials, vol. 5, Oct. 2006, pp. 759-762.
M. Wheeler et al., Three-Dimensional Array of Dielectric Spheres with an Isotropic Negative Permeability at Infrared Frequencies, Physical Review B 72, 193103-1-193103-4, 2005.
M. Wheeler et al , Coated Nonmagnetic Spheres with a Negative Index of Refraction at Infrared Frequencies, Physical Review 8 73, 045105-1-045105-7, 2006.
S. Xiao et al., Loss-Free and Active Optical Negative-Index Metamaterials, Nature, vol. 466, pp. 735-740, Aug. 2010.

* cited by examiner

*Primary Examiner* — Peter F Godenschwager
(74) *Attorney, Agent, or Firm* — Kevin W. Bieg

(57) ABSTRACT

A resonant dielectric metamaterial comprises a first and a second set of dielectric scattering particles (e.g., spheres) having different permittivities arranged in a cubic array. The array can be an ordered or randomized array of particles. The resonant dielectric metamaterials are low-loss 3D isotropic materials with negative permittivity and permeability. Such isotropic double negative materials offer polarization and direction independent electromagnetic wave propagation.

9 Claims, 8 Drawing Sheets

Composite Structure

High Permittivity Spheres

Low Permittivity Spheres

Effective-medium Calculations

CST Microwave Studio Stimulations (b) E-field (y-z plane, x = 2.5 mm)

(a) H-field (x-z plane, y =2.5 mm)

(b) Atomic force microscopy scan of $(Mg,Ca)TiO_3$ sphere surface (a) x-ray tomography scan of $(Mg,Ca)TiO_3$ sphere Foam Support Structure NaCl-like Cubic Unit Cell Two-sphere Unit Cell Eight-sphere NaCl-like Unit Cell

RESONANT DIELECTRIC METAMATERIALS

CROSS-REFERENCE TO RELATED APPLICATION

This application claims the benefit of U.S. Provisional Application No. 61/367,921, filed Jul. 27, 2010, which is incorporated herein by reference.

STATEMENT OF GOVERNMENT INTEREST

This invention was made with Government support under contract no. DE-AC04-94AL85000 awarded by the U.S. Department of Energy to Sandia Corporation. The Government has certain rights in the invention.

FIELD OF THE INVENTION

The present invention relates to metamaterials and, in particular, to three-dimensional (3D) isotropic resonant dielectric metamaterials.

BACKGROUND OF THE INVENTION

Negative refraction index metamaterials and their predicted effects have been theoretically studied, numerically analyzed, and experimentally demonstrated from microwaves to light by many researchers in the past decade. See V. G. Veselago and E. E. Narimanov, *Nature Materials* 5, 759 (2006). However, anisotropy, dispersion, high refractive index contrast, and particularly loss make the adoption of existing designs to the optical regime difficult without adding gain. See J. Valentine et al., *Nature* 455, 376 (2008); and S. Xiao et al., *Nature* 466, 735 (2010). In particular, conventional approaches for obtaining metamaterial properties ($\pm\epsilon_r$, $\pm\mu_r$) are based on orientation dependent, lossy metallic structures, e.g., split-ring resonator/wire pairs, fishnet and omega shaped structures. However, metamaterials comprising metallic resonators have high conduction loss and have a detailed geometry which is difficult to fabricate on a micron scale required for use at infrared and optical frequencies. Further, a metamaterial with isotropic negative permeability would require three orthogonal orientations of split-ring resonators.

An alternative route, via Mie resonances of magnetodielectric structures, provides a mechanism for engineered electrical and magnetic response. In particular, an all-dielectric metamaterial is easier to fabricate at RF to optical wavelengths, and can have a higher efficiency than metallic metamaterials because of not having metallic loss. In addition, an isotropic metamaterial can be achieved using dielectric spheres. Therefore, to achieve low-loss 3D isotropic scattering at very high frequencies, the unit cell or building block of the negative index material can be a directional independent non-metallic scatterer. For example, double negative (DNG) materials are man-made crystals, wherein the lattice configuration and unit-cell geometry affect scattering, and wherein the effective permeability and permittivity of the crystal can be simultaneously negative for wavelengths where the scatterers are resonant. The ideal directionally independent scatterer is a dielectric sphere. Cubic lattices of dielectric spheres have been predicted to exhibit the DNG property if the unit-cell contains a single sphere with similar relative permittivity and permeability embedded in an air-like host medium. See C. L. Holloway et al., *IEEE Trans. on Antennas and Propagation* 51, 2596 (2003). However, low-loss isotropic materials with scalar negative permittivity and permeability (or negative index of refraction) are straightforward to analyze, yet rather difficult to realize.

Another drawback to this approach is the simultaneous requirement on the permittivity and permeability. Because permeability greater than unity is difficult to obtain with low loss near optical frequencies, several researchers have proposed the two-sphere per unit cell approach. Spheres of different sizes or of the same-size but with different permittivities may be placed next to each other so that their electric and magnetic resonances overlap. See O. G. Vendik and M. S. Gashinova, *Proc. 34th European Microwave Conference* 3, 1209 (2004); and A. Ahmadi and H. Mosallaei, *Phys. Rev. B* 77, 045104 (2008). However, these designs are not strictly isotropic. See I. Vendik et al., *Microwave and Optical Technology Letters* 48, 2553 (2006). Another approach to isotropy is to develop bi-layered concentric spheres, commonly referred to as the core-shell structure. See E. F. Kuester et al., A double negative (DNG) composite medium based on a cubic array of layered nonmagnetic spherical particles, *URSI 2007—CNC/USNC North American Radio Science Meeting*, Ottawa, Canada, 2007. For the core-shell configuration, the key difficulty is numerical optimization. Another approach to DNG 3D isotropy at low-frequencies (L-band) uses artificial transmission lines loaded with reactive lumped elements. See A. Grbic and G. V. Eleftheriades, *J. Appl. Phys* 98, 043106 (2005). The key difficulties have been design optimization, material selection, and manufacturability.

Therefore, a need remains for a resonant dielectric metamaterial that is isotropic, easy to manufacture, and can be used to develop Ku/K band systems.

SUMMARY OF THE INVENTION

The present invention is directed to a resonant dielectric metamaterial comprising a dielectric matrix; a first set of dielectric particles embedded in the matrix, each particle of the first set being substantially identically shaped and having a substantially identical dielectric constant, the particles in the first set having a dielectric constant that is higher than the dielectric constant of the matrix; and a second set of dielectric particles embedded in the matrix, the second set being substantially identically shaped and having a substantially identical dielectric constant, the particles in the second set having a dielectric constant that is higher than the dielectric constant of the matrix and a permittivity that is different from the permittivity of the particles in the first set; and wherein the particles in the first and second sets are arranged in a cubic array. For example, the cubic array can comprise an ordered array of NaCl-like cubic unit cells or can comprise a randomized array. The dielectric particles are preferably spheres. For example, the dielectric particles in the first or second sets can comprise a high-refractive-index alumina-, zirconia-, or titania-based metal oxide ceramics, such as commercially available $Al_2O_3$, $Ba[Sn_x(Mg_{0.33}Ta_{0.67})_{1-x}]O_3$, $Ba(Zn_{0.33}Ta_{0.67})O_3$, $Ba(Mn_{0.33}Ta_{0.67})O_3$, $ZrO_2$, $(Y_xZr_{1-x})O_2$, $(Ce_xZr_{1-x})O_2$, $Ba_2Ti_9O_{22}$, $CaTiO_3$—$NdAlO_3$, $BaNd_2Ti_4O_{12}$, $(Ba,Pb)Nd_2Ti_4O_{12}$, $TiO_2$, $Mg_{0.95}Ca_{0.05}TiO_3$, $(Zr_xSn_{1-x})TiO_4$, $CaTiO_3$, or $SrTiO_3$.

The resonant dielectric metamaterials of the present invention are low-loss 3D isotropic materials with negative permittivity and permeability. Such isotropic double negative materials offer polarization and direction independent electromagnetic wave propagation.

BRIEF DESCRIPTION OF THE DRAWINGS

The accompanying drawings, which are incorporated in and form part of the specification, illustrate the present invention and, together with the description, describe the invention. In the drawings, like elements are referred to by like numbers.

FIG. 1(*b*) is a schematic illustration of the first set of high permittivity spheres. FIG. 1(*c*) is a schematic illustration of the second set of low permittivity spheres.

FIG. 2(*b*) shows graph of a full-wave simulation of the transmission spectrum of the composite using CST Microwave Studio.

FIG. 3(*a*) shows the H field in the x-z plane showing x-polarized magnetic dipoles inside the low permittivity spheres. FIG. 3(*b*) shows the E field in the y-z plane showing y-polarized electric dipoles inside the high permittivity spheres.

FIG. 4(*a*) is a p-CT scan showing the uniform, dense, and spherical nature of a $(Mg,Ca)TiO_3$ resonator. FIG. 4(*b*) is an AFM scan (30 μm×30 μm) illustrating the low surface roughness of the sphere.

FIG. 5(*b*) is a digital photograph of an offset 26×26 array, multi-layer foam support structure.

FIG. 6(*b*) is a graph of the experimental results of the configuration shown in FIG. 5(*a*), showing evidence of DNG propagation.

FIG. 7(*b*) is a graph of the transmission coefficient in the TE and TM orientations for an eight-sphere NaCl-like unit cell of the metamaterial of the present invention.

DETAILED DESCRIPTION OF THE INVENTION

A key aspect of metamaterials is that the characteristic structural length scale is small compared to the operating wavelength so that the electromagnetic properties of the metamaterial can be described in terms of effective electric permittivity (∈) and magnetic permeability (μ). However, since these quantities arise due to artificial structuring it is possible to achieve properties unlike those found in naturally-occurring materials. To date, most metamaterials have been fabricated using metallic unit cell structures in dielectric media. The unit cell structures are designed to exhibit resonances with the electromagnetic field at predetermined frequencies. The resonances can be electric or magnetic in nature, but in either case a strong dispersion of the optical constants (∈(ω), μ(ω), and the refractive index $n(\omega)=\sqrt{\in(\omega)\mu(\omega)}$) occur in the vicinity of resonances. This enables the metamaterial designer to "dial in" the optimal optical constants for a given application.

A composite medium comprising an array of dielectric scattering particles embedded in a background dielectric matrix can provide an effective negative permittivity and negative permeability simultaneously. Effective negative permittivities and permeabilities are possible if the effective electric and/or magnetic polarizabilities exhibit a characteristic resonant behaviour. In particular, when the size of the scattering particles and the distance between the scatterers is small compared to the wavelength in the matrix material and the wavelength is not small in the scatterer material, the effective medium parameters become frequency-dependent. In general, the scattering particle can comprise a dielectric disk, cube, cylinder, tetrahedron, or any general 3D shape capable of establishing dipole moments. The scattering particle is preferably a sphere to maximize the isotropic response. Preferably, the scattering particles have a high dielectric constant compared to the host matrix. Preferably, the medium provides isotropy of the effective permittivity and permeability. For example, isotropy is a general characteristic of a cubic structure. According to the present invention, a 3-D isotropic resonant dielectric material is achieved by a cubic array comprising two particles having the substantially the same size but different permittivities. In general, the cubic array can comprise an ordered structure, such as a NaCl-like or CsCl-like unit cell, or can comprise a random array of particles.

Figure 1A:
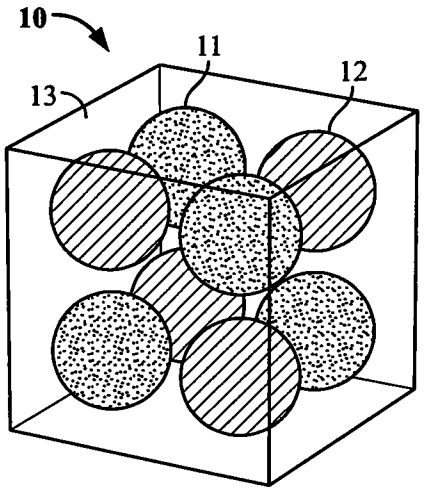
FIG. 1(*a*) is a schematic illustration of a composite NaCl-like cubic unit cell comprising two sets of ordered same-sized spherical scattering particles, wherein the particles in the first set have a different permittivity from the particles in the second set.
Figure 1B:
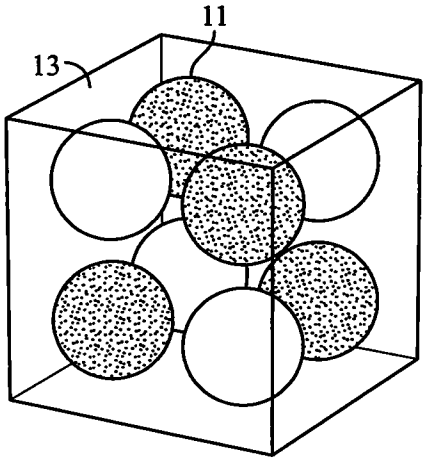
Figure 1C:
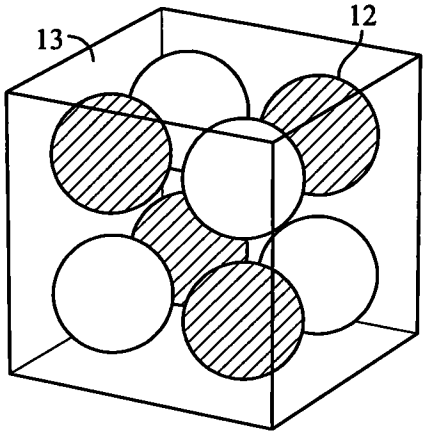
Figure 2A:
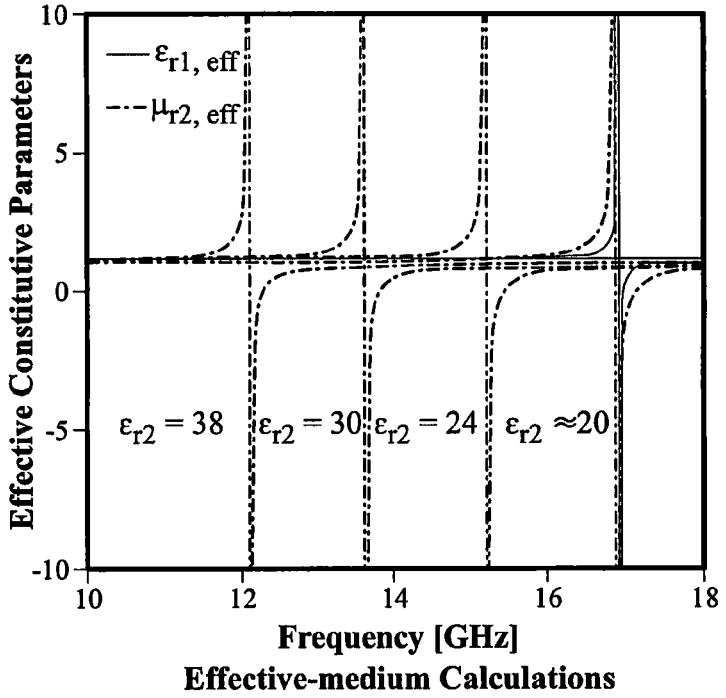
FIG. 2(*a*) shows a graph of an effective-medium calculation based on a composite NaCl-like cubic lattice comprising two sets of 2-mm radius spheres with different permittivities, $\in_{r1}=38$ and $\in_{r2}=20$, with a lattice dimension of 10 mm.
Figure 2B:
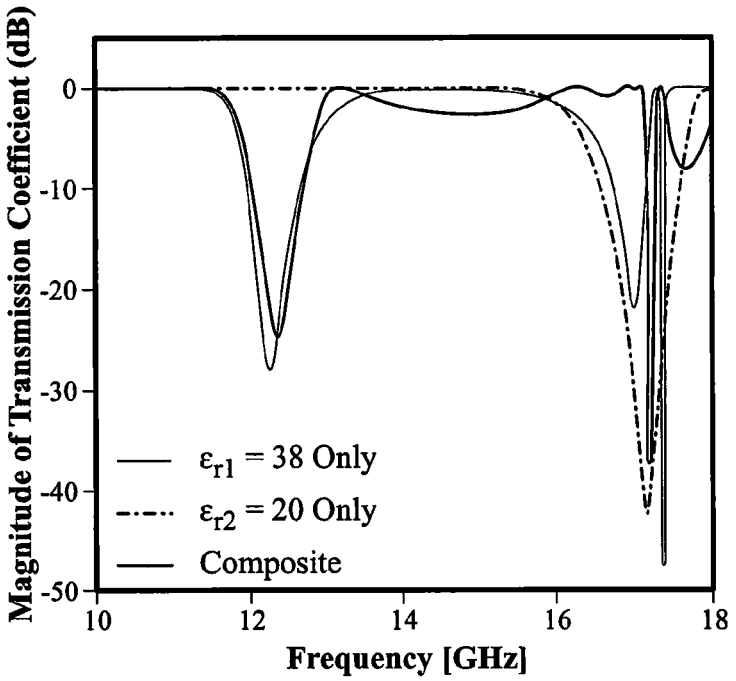

FIG. 1(*a*) is a schematic illustration of an exemplary composite NaCl-like cubic unit cell comprising same-sized spherical scatters with different permittivities. The composite medium 10 comprises two sets of dielectric spheres 11 and 12 embedded in a dielectric host matrix 13. Each sphere has substantially the same radius, r, but each of the sets has different permittivities, $\in_{r1}$ and $\in_{r2}$. For example, FIG. 1(*b*) shows a composite unit cell comprising of first set of spheres 11 with high permittivity. For example, FIG. 1(*c*) shows a composite unit cell comprising a second set of spheres 12 with lower permittivity. In this example, the metamaterial comprises an isotropic three-dimensional array of two sets of dielectric spheres providing a NaCl-like cubic unit-cell building block. In this structure, each set forms a separate face-centered cubic lattice, with the two lattices interpenetrating to form a 3D checkerboard pattern. One set of spheres in the unit cell provides an electric resonance at about the same frequency that the other set of spheres provides a magnetic resonance, thereby providing the DNG property. The dielectric spheres can have a dielectric constant that is substantially larger than the dielectric constant of the host matrix material and the first set of dielectric spheres can have a permittivity that is greater than the permittivity of the second set of dielectric spheres. Because the size of the spheres is substantially similar, the ratio of the absolute value of the index of refraction of the spheres is important in order for the electric resonance to overlap with the magnetic resonance. Lowering of the absolute value of the refractive index while maintaining their ratio improves the impedance mismatch with free-space As an example of the present invention and using the concept of the metamaterial alphabet, NaCl-like cubic unit cells with a lattice constant of 10 mm comprising 2-mm dielectric spheres were investigated using effective-medium equations and CST Microwave Studio simulations. See A. Ahmadi and H. Mosallaei, *Phys. Rev. B* 77, 045104 (2008); and C. L. Holloway et al., *IEEE Trans. on Antennas and Propagation* 51, 2596 (2003). FIG. 2(*a*) is a graph of the effective-medium calculations based on cubic lattices of two sets of 2-mm diameter dielectric spheres as shown in FIGS. 1(*b*)-(*c*), each spaced 10 mm apart. The effective-medium calculations predict that the effective permeability $\mu_{r2}$ of the second set of spheres overlaps with the effective permittivity of the first set of high permittivity spheres ($\in_{r1}$=38) as the second spheres' permittivity $\in_{r2}$ is tuned from 38 to 20, resulting in a DNG near 17 GHz when the permittivity of the second set of spheres is $\in_{r2}$~20. At this frequency, both the permeability and permittivity become negative simultaneously, producing a negative-index material. FIG. 2(*b*) shows a full-wave simulation of the transmission coefficient versus frequency for the configurations shown in FIG. 1 using CST Microwave Studio simulations. These simulations confirm the effective-medium calculations. The figure shows the magnetic resonance of the high permittivity spheres creates a band gap in the composite transmission near 12 GHz. However, at near 17 GHz, the separate but overlapping band gaps of the high and low permittivity spheres produce a large band-pass region of almost 1 GHz in the composite structure. Because the band gaps in the configurations shown in FIGS. 1(*b-c*) are due to effective permittivity and permeability being negative to their positive counterparts, respectively, it is reasonable to deduce that the transmission in the composite material is due to DNG propagation, i.e. the negative properties of one set of spheres overcomes the corresponding positive property of the other set of spheres in the composite. The range and preferred frequencies of operation can be extended beyond RF frequencies by linear scaling of the particle and lattice dimensions.

Figure 3:
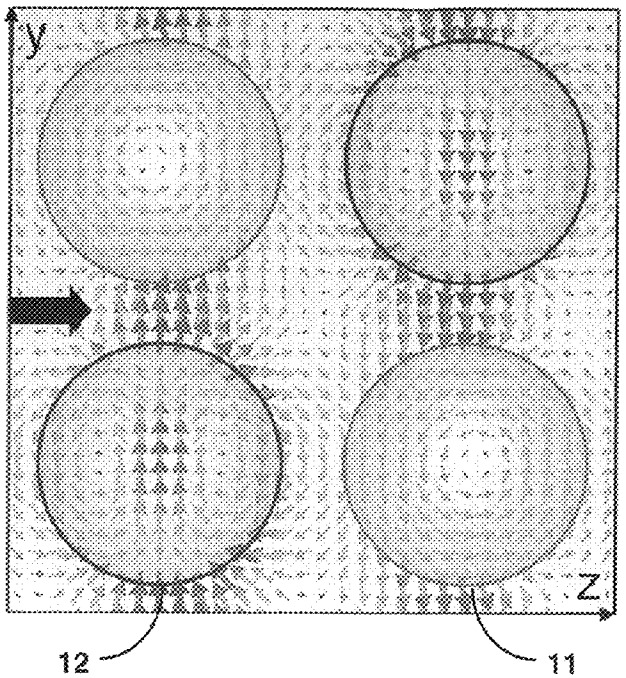
FIG. 3 shows simulated field distributions at 16.76 GHz inside the unit cell of FIG. 1(*a*); black arrows indicate direction of propagation of a y-polarized plane wave.
Figure 3:
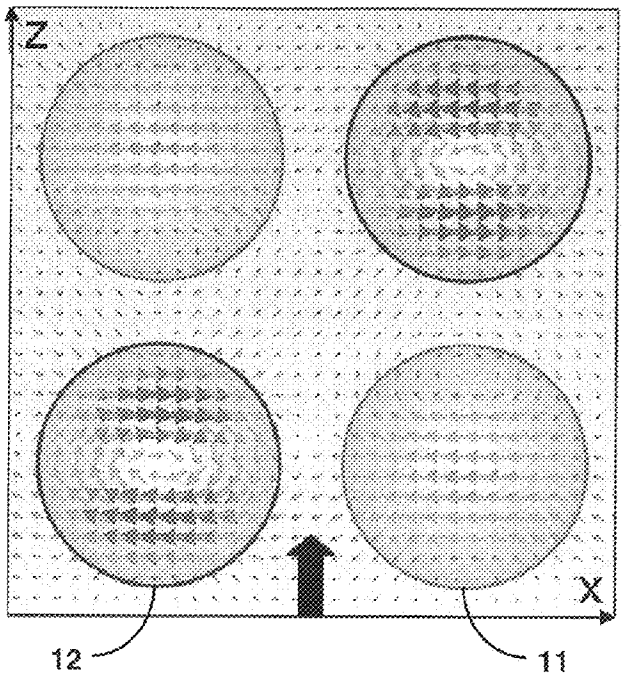

To verify the above calculations, electric and magnetic field distributions were examined at 16.76 GHz, where both effective permittivity and permeability are negative. FIG. 3 shows the simulated field distributions at 16.76 GHz inside the unit cell of FIG. 1(*a*). The black arrow in these figures indicates the direction of propagation of a y-polarized plane wave. FIG. 3(*a*) shows the H-field in the x-z plane showing x-polarized magnetic dipoles inside the lower permittivity spheres 11. FIG. 3(*b*) shows the E-field in the y-z plane showing y-polarized electric dipoles inside the higher permittivity spheres 12. These figures clearly demonstrate the development of electric and magnetic dipole modes near 17 GHz as predicted by effective-medium calculations. The concurrent existence of symmetric dipole resonances coupled with simulated near-unity transmission indicates that isotropic low-loss DNG propagation has occurred at this frequency. Phase distributions of E field (not shown) also support this finding.

Table I shows commercial RF dielectric compositions that include permittivity values corresponding to the dielectric spheres of the exemplary composite material described above. These compositions have a high permittivity, $\in_r$, and low dielectric loss tangent, tan δ.

TABLE I

Commercial RF dielectric compositions with properties comparable to simulation material parameters.

| Composition | $\epsilon_r$ | tan δ (•$10^{-4}$) |
|---|---|---|
| $Al_2O_3$ | 10 | 3 |
| $Mg_{0.95}Ca_{0.05}TiO_3$ | 20 | 9 |
| $Ba[Sn_x(Mg_{0.33}Ta_{0.67})_{1-x}]O_3$ | 25 | 2 |
| $Ba(Zn_{0.33}Ta_{0.67})O_3$ | 30 | 9 |
| $(Zr_xSn_{1-x})TiO_4$ | 38 | 5 |
| $Ba_2Ti_9O_{22}$ | 39 | 5 |
| $CaTiO_3$—$NdAlO_3$ | 45 | 5 |
| $BaNd_2Ti_4O_{12}$ | 77 | 5 |
| $(Ba, Pb)Nd_2Ti_4O_{12}$ | 90 | 5 |
| $TiO_2$ | 100 | 3 |
| $CaTiO_3$ | 170 | 30 |
| $SrTiO_3$ | 270 | 50 |

Figure 4:
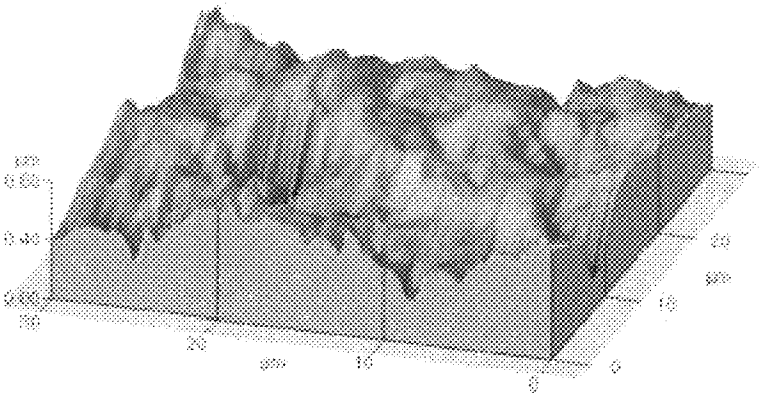
FIG. 4 shows non-destructive evaluation of prepared dielectric resonators.
Figure 4:
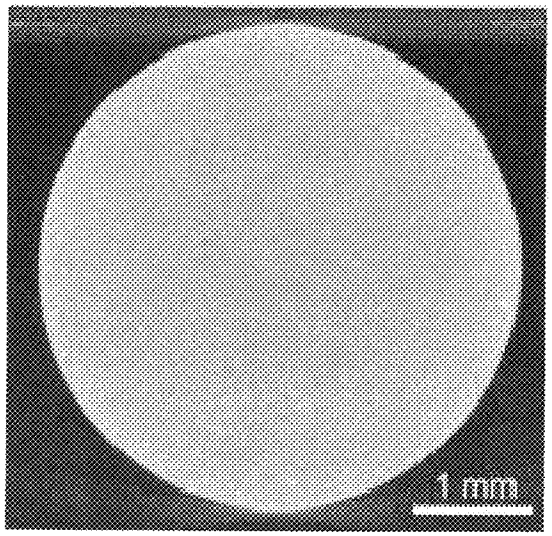

To verify numerical analysis and simulations, dielectric spheres of $(Zr_xSn_{1-x})TiO_4$ (ZST) and $Mg_{0.95}Ca_{0.05}TiO_3$ (MCT) were prepared through standard ceramic processing methods. Commercial powders were cold isostatically pressed, and the resulting compacts were sintered at temperatures greater than 1350° C. The resulting dense spheres were lapped, polished and sorted to obtain the desired dimensions, r=2 mm, conforming to the simulation parameters. Non-destructive evaluation techniques, such as x-ray tomography (μ-CT) and atom force microscopy (AFM), can be used to quantify sphericity, surface roughness, and microstructural characteristics. FIG. 4(*a*) is a p-CT scan showing the uniform, dense, and spherical nature of a $(Mg,Ca)TiO_3$ resonator particle. FIG. 4(*b*) is an AFM scan (30 μm×30 μm) illustrating the low surface roughness of the sphere. As described by Vendik et al., one must consider the strict limitation imposed on the manufacturing process of resonators. Specifically, any finite distributions in resonator diameter and/or corresponding permittivity variations can potentially result in statistical scatter of resonant frequencies outside of the composite's working bandwidth. See Vendik et al., *Microwave and Optical Technology Letters* 48, 2553 (2006). Table II shows the tight tolerances associated with the established resonator manufacturing process.

TABLE II

Commercial RF dielectric compositions with properties comparable to simulation material parameters

| | $(Zr, Sn)TiO_4$ spheres | $(Mg, Ca)TiO_3$ spheres |
|---|---|---|
| Weight (g) | 0.168 +/− 0.001 | 0.127 +/− 0.002 |
| Diameter (cm) | 0.400 +/− 0.000 | 0.398 +/− 0.000 |
| Relative Density (%) | >97 | >99 |
| Roughness RMS (μm) | 0.575 | 0.257 |

Dielectric measurements verified that the prepared resonators displayed the as-desired permittivities of $\in_{ZST}$=38 and $\in_{MCT}$=20 with Q values in excess of 1000.

Figure 5B:
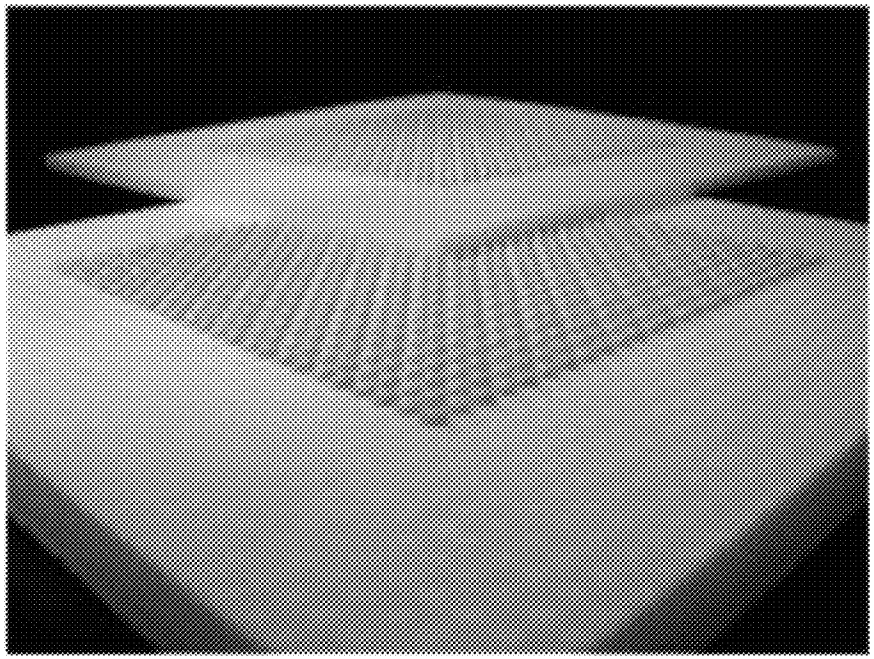
FIG. 5(*a*) is a schematic illustration of a composite NaCl-like cubic unit cell lattice comprising two sets of 2-mm radius spheres with different permittivities, $\in_{r1}=38$ and $\in_{r2}=20$, with a lattice constant of 10 mm.
Figure 5A:
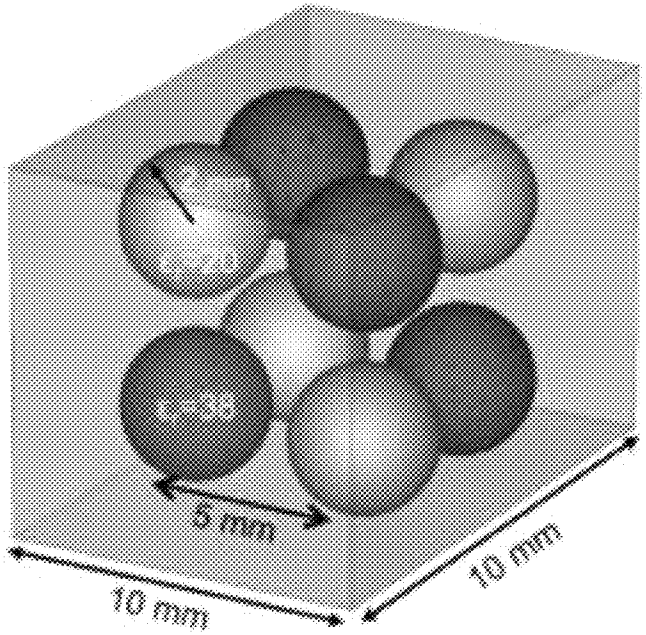

For characterization, ROHACELL® 31HF foam templates were machined to serve as a 3D support structure for the dielectric sphere matrix. FIG. 5(*a*) is a schematic illustration of the composite unit cell comprising same-sized spherical scatters with different permittivities. The high permittivity spheres are $(Zr,Sn)TiO_4$ and low permittivity spheres are $(Mg,Ca)TiO_3$. FIG. 5(*b*) shows a digital photograph of an offset 26×26 array, multi-layer foam support structure.

Figure 6A:
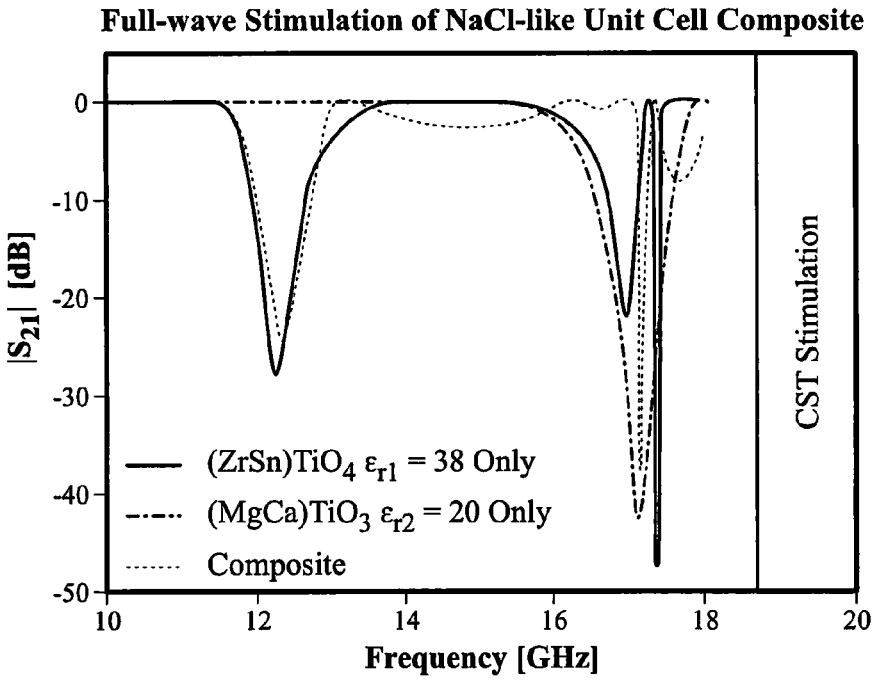
FIG. 6(*a*) is a graph of a full-wave simulation using CST Microwave Studio of the configuration shown in FIG. 5(*a*).
Figure 6B:
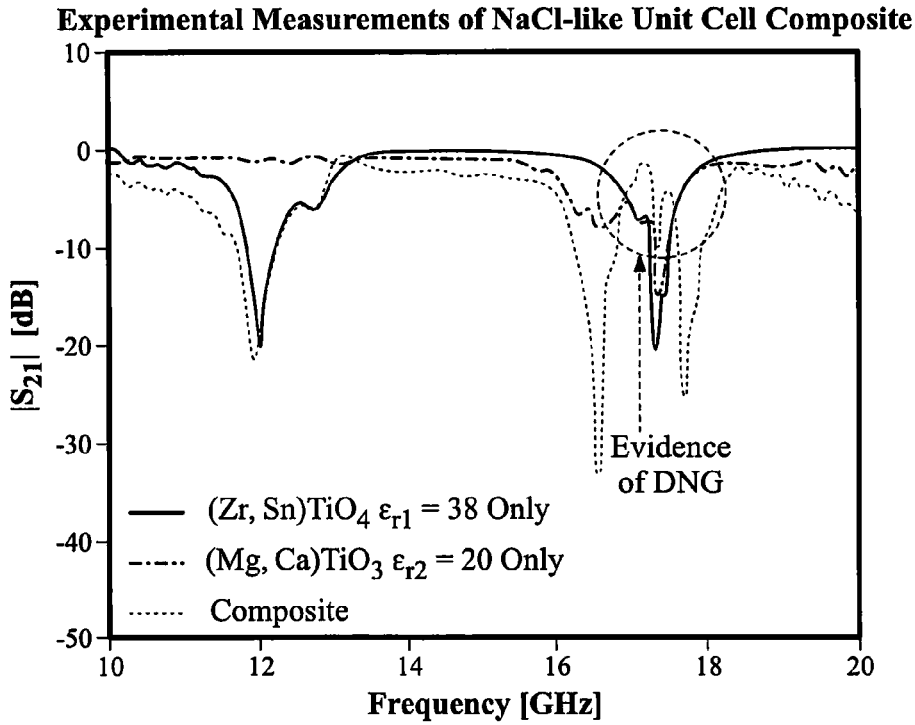

As described above, effective-medium results predict that when a set of dielectric spheres (r=2 mm) with $\in_{r1}$=38 overlaps with a second set of similar sized spheres with $\in_{r2}$=20 in a NaCl-like lattice, enhanced transmission results near 17 GHz. FIG. 6(*a*) shows the full-wave simulation of the actual NaCl-like cubic configuration comprising 2-mm radius $(Zr, Sn)TiO_4$ ($\in_r$≈38) and $MgCaTiO_3$ ($\in_r$=20) spheres situated in a 10-mm NaCl-like cubic lattice inside a ROHACELL® HF foam support structure. This figure shows that magnetic resonance of the ZST spheres induces a band gap in the composite transmission near 12 GHz. However around 17 GHz, the separate but overlapping band gaps of ZST and MCT spheres produces a large band-pass region of almost 1 GHz in the composite structure. FIG. 6(*b*) shows the experimental results for the NaCl-like cubic unit cell structure. When the ZST and MCT spheres were combined together in the cubic structure, a band-pass response was observed due to both permittivity and permeability being negative. The experimental measurements observe enhanced transmission response(s) in regions where both the response of the dielectric spheres have $S_{21}$ magnitudes, highlighted with low losses ~1 dB/wavelength.

Figure 7A:
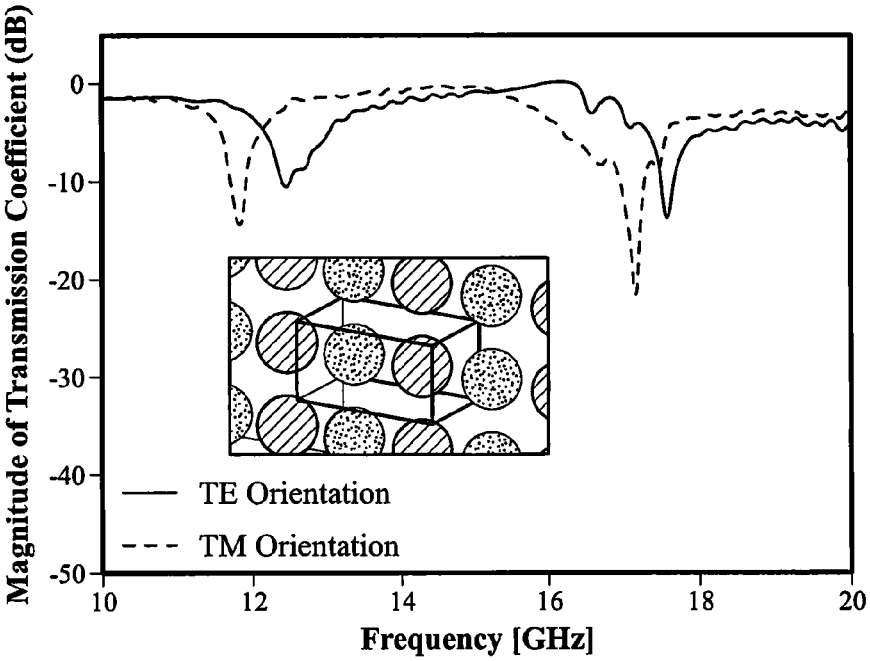
FIG. 7(*a*) is a graph of the transmission coefficient in the TE and TM orientations for a two-sphere unit cell DNG metamaterial.
Figure 7B:
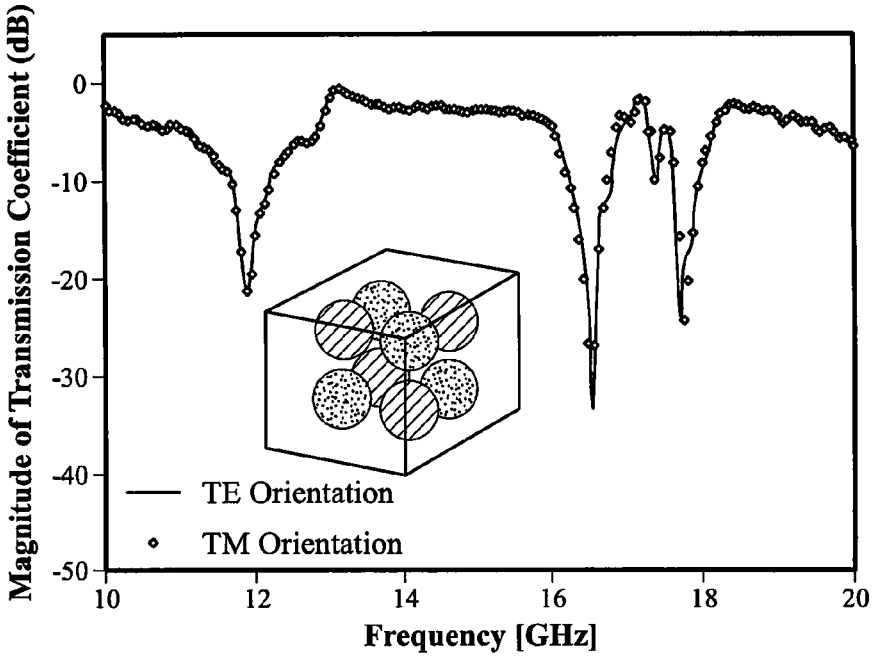

FIG. 7(*a*) shows a graph of the transmission coefficient in the TE and TM orientations for the two-sphere unit cell DNG metamaterial described by Ahmadi. See A. Ahmadi and H. Mosallaei, *Phys. Rev. B* 77, 045104 (2008). The two-sphere unit cell exhibits DNG behaviour for TE, but not TM, polarized waves. Therefore, the transmission is orientation-dependent, indicating an anisotropic material. The NaCl-like cubic unit cell of the present invention enables an isotropic negative index material. FIG. 7(*b*) shows a graph of the transmission coefficient in the TE and TM orientations for the eight-sphere NaCl unit cell of the metamaterial of the present invention. NaCl-like cubic unit cell exhibits DNG behavior for both TE and TM polarized waves. Therefore, the transmission is not dependent on orientation, indicating an isotropic metamaterial.

Figure 8:
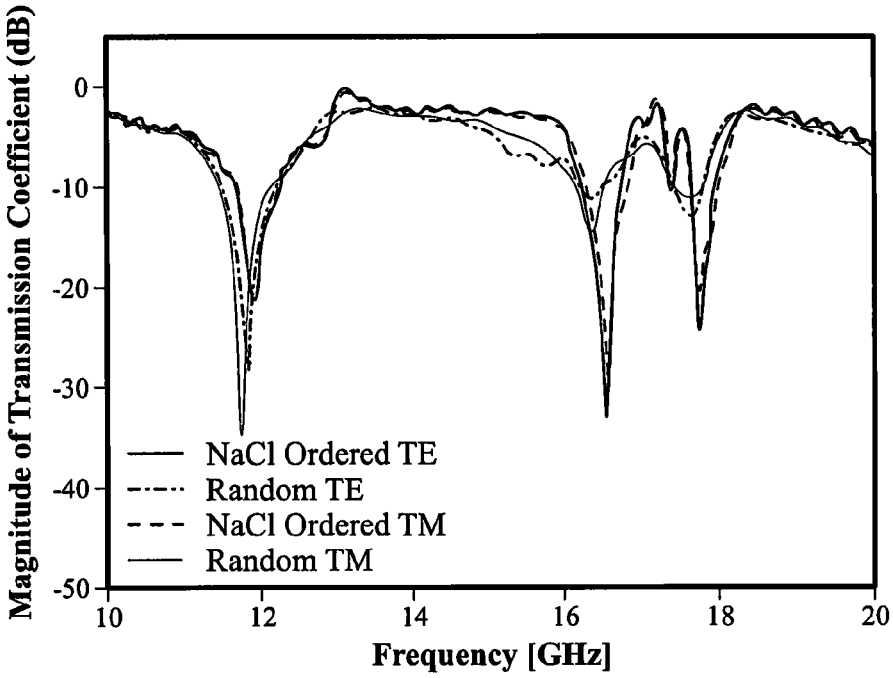
FIG. 8 is a graph of the transmission coefficient in the TE and TM orientations for a random composite DNG metamaterial.

A randomized array of similar-sized dielectric spheres of different permittivity configured in a cubic lattice can produce a response similar to that of an ordered lattice. FIG. 8 shows a graph of the transmission coefficient in the TE and TM orientations for ZST and MST spheres arranged randomly in a cubic array compared to the ordered NaCl-like unit cell. The fact that the transmission coefficients are similar in shape and resonance location for both the random and NaCl-like cubic lattices indicates that the local proximity of electrical and magnetic responses is not critical to the desired transmission response of the composite metamaterial. However, additional loss, in this case about 3 dB, was observed with the random composite. A random composite may be more scalable to high frequencies because as the spheres get smaller, it can be more difficult to arrange them in a precise fashion. Therefore, a high-frequency DNG material comprising a random composite may be easier to fabricate.

The isotropic negative index metamaterial of the present invention enables the construction of flat compact perfect dielectric lenses, spatial filters, electrically-small antennas, and prisms at RF frequencies. The example described herein can be scaled to near optical frequencies enabling the use of nano-spheres to produce similar effects.

The present invention has been described as a resonant dielectric metamaterial. It will be understood that the above description is merely illustrative of the applications of the principles of the present invention, the scope of which is to be determined by the claims viewed in light of the specification. Other variants and modifications of the invention will be apparent to those of skill in the art.

We claim:

1. A resonant dielectric metamaterial, comprising:

a dielectric matrix;

a first set of dielectric particles embedded in the matrix, each particle of the first set being substantially identically shaped and having a substantially identical permittivity, the particles in the first set having a dielectric constant that is higher than the dielectric constant of the matrix; and a second set of dielectric particles embedded in the matrix, the second set being substantially identically shaped and having a substantially identical permittivity, the particles in the second set having a dielectric constant that is higher than the dielectric constant of the matrix and a permittivity that is different from the permittivity of the particles in the first set; and wherein the dielectric particles in the first and second sets are arranged in cubic array and wherein the dielectric particles in the first or second set comprise an alumina-, zirconia-, or titania-based ceramic.

2. The resonant dielectric metamaterial of claim 1, wherein the cubic array comprises an ordered array of NaCl-like unit cells.

3. The resonant dielectric metamaterial of claim 1, wherein the cubic array comprises a randomized array.

4. The resonant dielectric metamaterial of claim 1, wherein the dielectric particles comprise a dielectric sphere.

5. The resonant dielectric metamaterial of claim 1, wherein the dielectric particles comprise a dielectric disk, cube, cylinder, tetrahedron.

6. The resonant dielectric metamaterial of claim 1, wherein the dielectric particles have a cross-sectional dimension of less than two millimeters.

7. The resonant dielectric metamaterial of claim 1, wherein the dielectric particles are spaced less than five millimeters apart.

8. The resonant dielectric metamaterial of claim 1, wherein the dielectric particles in the first or second set comprise $Mg_{0.95}Ca_{0.05}TiO_3$ or $(Zr_xSn_{1-x})TiO_4$.

9. The resonant dielectric metamaterial of claim 1, wherein the dielectric particles in the first or second set comprise $Al_2O_3$, $Ba[Sn_x(Mg_{0.33}Ta_{0.67})_{1-x}]O_3$, $Ba(Zn_{0.33}Ta_{0.67})O_3$, $Ba(Mn_{0.33}Ta_{0.67})O_3$, $ZrO_2$, $(Y_xZr_{1-x})O_2$, $(Ce_xZr_{1-x})O_2$, $Ba_2Ti_9O_{22}$, $CaTiO_3$—$NdAlO_3$, $BaNd_2Ti_4O_{12}$, $(Ba,Pb)Nd_2Ti_4O_{12}$, $TiO_2$, $CaTiO_3$, or $SrTiO_3$.

* * * * *